US005437641A

United States Patent [19]

Cameron

[11] Patent Number: 5,437,641

[45] Date of Patent: Aug. 1, 1995

[54] RETRIEVAL SYSTEM FOR A RANGE ANIMAL INJECTION APPARATUS

[76] Inventor: Donald J. Cameron, R.R. #3, Ponoka, Alberta, Canada, T4J 1R3

[21] Appl. No.: 355,978

[22] Filed: Dec. 14, 1994

[51] Int. Cl.[6] ..... A61M 5/20

[52] U.S. Cl. ..... 604/130; 273/418

[58] Field of Search ..... 604/130, 144; 273/418

[56] References Cited

U.S. PATENT DOCUMENTS

| | | | |
|---|---|---|---|
| 1,561,854 | 11/1925 | Hein . | |
| 2,168,437 | 9/1939 | Buercklin | 128/218 |
| 2,348,337 | 9/1944 | Francis | 102/92 |
| 2,744,527 | 5/1956 | Barrett et al. | 128/216 |
| 2,854,925 | 10/1958 | Crockford et al. | 102/92 |
| 2,899,960 | 8/1959 | Ginsburg | 128/221 |
| 3,022,785 | 2/1962 | Crockford et al. | 128/218 |
| 3,099,988 | 8/1963 | Ginsburg | 128/221 |
| 3,207,157 | 9/1965 | Murdoch | 273/418 |
| 3,314,286 | 4/1967 | Hickerson et al. | 73/167 |
| 3,334,788 | 8/1967 | Hamilton | 222/43 |
| 3,359,979 | 12/1967 | Murdoch | 128/218 |
| 3,433,223 | 3/1969 | Black | 128/218 |
| 3,605,744 | 9/1971 | Dwyer | 128/218 F |
| 3,721,241 | 3/1973 | Klohr et al. | 128/221 |
| 3,747,247 | 7/1973 | McNair | 42/41 L |
| 3,780,734 | 12/1973 | Wulff | 128/218 R |
| 3,880,162 | 4/1975 | Simmons | 128/218 R |
| 4,103,893 | 8/1978 | Walker | 604/130 |
| 4,182,327 | 1/1980 | Haley | 604/130 |
| 4,243,036 | 1/1981 | Ott | 128/215 |
| 4,684,366 | 8/1987 | Denny et al. | 604/130 |
| 4,717,384 | 1/1988 | Waldeisen | 604/143 |
| 4,726,594 | 2/1988 | Benke | 604/130 |
| 4,735,611 | 4/1988 | Anderson et al. | 604/130 |
| 4,735,612 | 4/1988 | Chevalier | 604/130 |
| 4,863,428 | 9/1989 | Chevalier | 604/130 |
| 5,202,533 | 4/1993 | Vandersteen | 102/512 |
| 5,295,971 | 5/1994 | Cameron | 604/187 |

FOREIGN PATENT DOCUMENTS 1014573 4/1983 U.S.S.R. .

OTHER PUBLICATIONS

Brochure of Cow Poke, Inc.—Air-Powered Pole Syringe.

Brochure of Cap-Chur—pp. 7 and 17 re: Syringes.

*Primary Examiner*—Paul J. Hirsch

*Attorney, Agent, or Firm*—Anthony R. Lambert

[57] ABSTRACT

A retrieval system for a range animal injection apparatus is described. The retrieval system includes a valve positioned between a syringe and a needle. In an open position there is a free flow of liquids from a syringe to the needle. In the closed position flow is precluded. A contact member is movable axially in relation to the needle between a first end and a second end. A rigid coupling couples the movement of the contact member and a valve member. The valve is in a closed position when the contact member is positioned adjacent the second end of the needle. The valve is in an open position when the contact member is positioned adjacent the first end of the needle. When the second end of the needle enters a hide of an animal the contact member is pushed toward the first end of the needle by the hide of the animal forcing the valve into the open position. Pressure from a pressure source urges liquid medication in the syringe passed the open valve member through the needle until the liquid medication has vacated the syringe. Continued pressure from the pressure source then urges the valve member into the closed position, thereby moving the contact member toward the second end of the needle until the contact member pushes the needle out of the hide of the animal.

1 Claim, 4 Drawing Sheets

RETRIEVAL SYSTEM FOR A RANGE ANIMAL INJECTION APPARATUS

FIELD OF THE INVENTION

The present invention relates to a retrieval system for a range animal injection apparatus having a syringe positioned along a shaft with a needle having a first end secured to the syringe and a second end projecting past a remote end of the shaft. A pressure source acts upon the syringe to force liquid medication from the syringe through the needle upon the second end of the needle being inserted into a hide of an animal.

BACKGROUND OF THE INVENTION

One cannot walk up to a range animal to administer an injection of medication, in the same fashion one can approach a domesticated farm animal. Ranchers have, therefore, developed specialized delivery systems to assist them in injecting medication into range animals. These delivery systems consist of pole mounted syringes or syringe bearing missiles that enable the rancher to reach a fast moving range animal from a distance. The syringes are connected to a pressure source that force the medication from the syringe upon the needle penetrating the hide of the animal.

Once the hide of the animal has been pierced by the needle on the syringe, the animal usually bolts. The rancher cannot hope to keep pace with the animal, and therefore must wait until the needle works its way out of the animal before retrieving his pole or missile. The normal operation of gravity results in the needle eventually working its way out of the hide of the animal. However, experience has shown that this can be extremely irritating to the animal. After the needle has fallen out as a result of gravity, the animal is obviously distressed and does not resume it normal activities for a considerable length of time. The animal makes a connection between the discomfort experienced and the presence of the rancher, making it even more difficult for the rancher to approach the animal in future.

In order to address this problem, retrieval systems have been employed in which a substantial length of string is attached to the pole or missile. The advantage of the string retrieval system is that the needle may be pulled out by means of the string as soon as the rancher is confident the medication has been administered. The animal suffers less distress and is able to resume its normal activities more rapidly. The animal is less likely to associate the temporary discomfort with the rancher. However, string retrieval systems have other disadvantages associated with them. The string gets dragged through manure and dirt in the pasture or feed lot, making it a messy solution. The string often gets caught, resulting in the needle being pulled out prematurely. There are a multitude of ways in which the string can get caught. For example, it can become wrapped in the feet of other cattle, or around bushes as the animal weaves back and forth after having bolted at the time of the injection. Unless a substantial length of string is employed, a fast moving animal can reach the end of the string, resulting in the needle being pulled out before the full dosage of medication has been administered. However, the longer the length of string employed the more tangles the rancher must deal with before he is in a position to use the delivery system to administer another injection. Even if all else goes well, there is always a danger that when the rancher pulls the string, the needle will comes flying back at him.

SUMMARY OF THE INVENTION

What is required is a safer alternative to the string retrieval system for a range animal injection apparatus.

According to the present invention there is provided a retrieval system for a range animal injection apparatus. A syringe positioned along a shaft a pole, an arrow or a dart; depending upon the form that the injection apparatus takes. A needle is provided having a first end secured to the syringe and a second end projecting past a remote end of the shaft. A pressure source acts upon a plunger in the syringe to force liquid medication from the syringe through the needle upon the second end of the needle being inserted into a hide of an animal. The retrieval system includes a valve positioned adjacent a first end of the needle. The valve includes a passage and a pressure sensitive valve member movable axially in relation to the passage between an open position and a closed position. In the open position the valve member is spaced from the passage thereby allowing the free flow of liquids from the syringe to the needle. In the closed position the valve member is lodged in the passage thereby precluding the flow of liquids from the syringe to the needle. A contact member is movable axially in relation to the needle between the first end and the second end. A rigid coupling couples the movement of the contact member and the valve member. The valve being in a closed position when the contact member is positioned adjacent the second end of the needle. The valve is in an open position when the contact member is positioned adjacent the first end of the needle. When the second end of the needle enters a hide of an animal the contact member is pushed toward the first end of the needle by the hide of the animal forcing the valve into the open position. Pressure from the pressure source urges liquid medication in the syringe passed the open valve member through the needle until the liquid medication has vacated the syringe. Continued pressure from the pressure source then urges the valve member into the closed position, thereby moving the contact member toward the second end of the needle until the contact member pushes the needle out of the hide of the animal.

The retrieval system, as described above, ensures that the needle is ejected from the hide of the animal just as soon as the medication has been delivered. Premature ejection of the needle before the full dose of medication has been administered is avoided. Similarly, any delays in removing the needle to the point of irritating the hide and upsetting the animal is avoided. The retrieval system, as described above, does not have all of the inherent disadvantages present in the string retrieval system.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred embodiment, a retrieval system for a range animal injection apparatus will now be described with reference to FIGS. 1 through 7.

Figure 1:
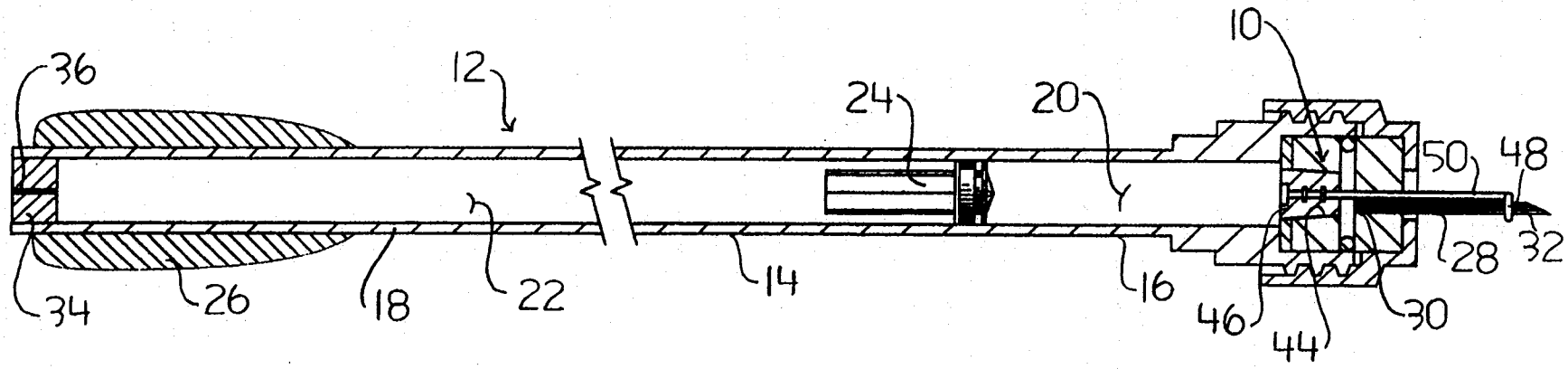
FIG. 1 is a side elevation view in longitudinal section of a range animal injection apparatus equipped with a retrieval system according to the teachings of the present invention.

Referring to FIG. 1, range animal injection apparatus is in the form of an arrow 12. It will be appreciated that it can be made larger and mounted on a pole, or it can be made smaller and placed within a dart. Arrow 12 consists of a shaft 14 having a first end 16 and a second end 18. A syringe is positioned at first end 16 of shaft 14. With a pole style delivery system it would not matter if the syringe were externally mounted to shaft 14. However, in this preferred embodiment, in order to balance arrow 12 and remove any appendages that would hamper the ability to shoot arrow 12 from a bow, shaft 14 has a hollow interior cavity divided into two compartments 20 and 22 by a plunger 24. Compartment 20 is positioned adjacent first end 16 of shaft 14 and forms part of the syringe, and will hereinafter be referred to as "syringe compartment". Compartment 22 is positioned adjacent second end 18 of shaft 14 and forms part of a pressure source, and will hereinafter be referred to as "pressure compartment". Polymer plastic flights 26 are secured to shaft 14 adjacent second end 18. A needle 28 is positioned at first end 16 of shaft 14. Needle 28 has a first end 30 and a second end 32. First end 30 communicates with syringe compartment 20. Second end 32 projects past first end 16 of shaft 14. Second end 18 of shaft 14 has a rubber plug 34 with a self sealing passage 36 therethrough. Passage 36 is adapted to receive a needle valve (not shown) so that air can be pumped into pressure compartment 22. This manner of pressurizing pressure compartment 22 is analogous to the manner in which a soccer ball, football or basketball is filled with air. This pressurized air within pressure compartment 22 acts upon plunger 24. When a pressure imbalance is created between syringe compartment 20 and pressure compartment 22, plunger 24 will move to compress syringe compartment 20. This forces liquid medication, identified by reference numeral 38 in FIG. 6, from syringe compartment 20 through needle 28 upon second end 32 of needle 28 being inserted into a hide 40 of an animal 42.

Figure 2:
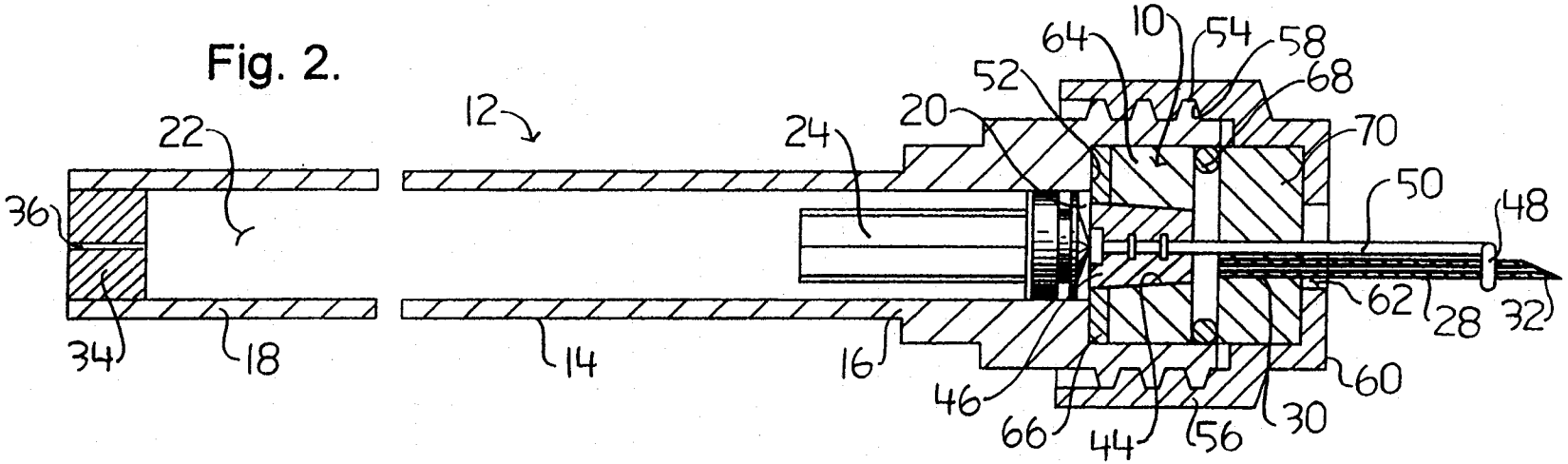
FIG. 2 is a detailed side elevation view in longitudinal section of the range animal injection apparatus as illustrated in FIG. 1 with a valve in a closed position.
Figure 3:
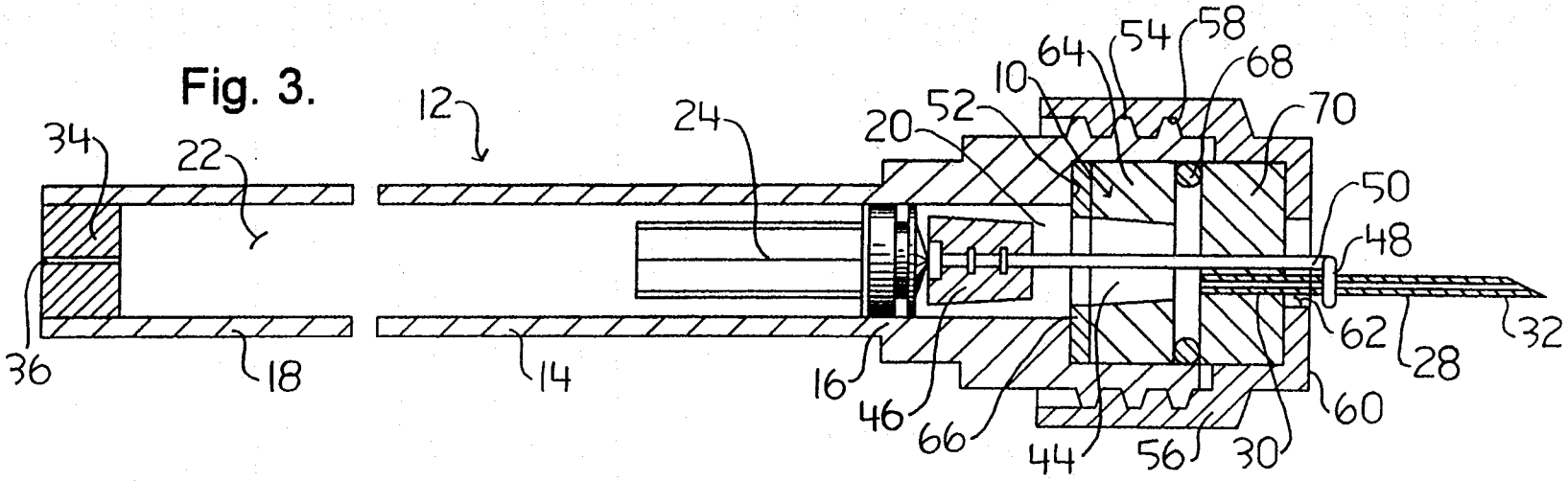
FIG. 3 is a detailed side elevation view in longitudinal section of the range animal injection apparatus as illustrated in FIG. 1 with the valve in an open position.

The retrieval system which serves as the subject matter of the present invention will now be described. Referring to FIG. 1, the retrieval system includes a valve, generally identified by reference numeral 10. Valve 10 is positioned adjacent first end 30 of needle 28. Valve 10 includes a passage 44 and a pressure sensitive valve member 46 movable axially in relation to passage 44 between an open position and a closed position. In the open position, illustrated in FIG. 3, valve member 46 is spaced from passage 44 thereby allowing the free flow of liquids from syringe compartment 20 to needle 28. In the closed position, illustrated in FIG. 2, valve member 46 is lodged in passage 44 thereby precluding the flow of liquids from syringe compartment 20 to needle 28. A contact member 48 is movable axially in relation to needle 28 between first end 30 and second end 32. A rigid pin-like coupling 50 couples the movement of contact member 48 and valve member 46. Referring to FIG. 2, when valve 10 is in the closed position with valve member 46 positioned in passage 44, contact member 48 is positioned adjacent second end 32 of needle 28. Referring to FIG. 3, when valve 10 is in the open position with valve member 46 spaced from passage 44, contact member 48 is positioned adjacent first end 30 of needle 28. Referring to FIGS. 2 and 3, for ease of assembly valve 10 and first end 16 of shaft 14 are constructed of a number of co-operating components. First end 16 of shaft 14 has both internal shoulders 52 and external threads 54. An end cap 56 is provided that can be threaded onto external threads 54. End cap 56 has internal threads 58, and an end 60 with a passage 62 extending therethrough. A number of components are positioned between internal shoulders 52 and end cap 56. An annular spacer 64 is provided that has passage 44 extending therethrough. A first annular seal 66 is positioned on one side of annular spacer 64 resting against shoulders 52. A second annular seal 68 is positioned on the opposed side of annular spacer 64. First annular seal 66 and second annular seal 68 are intended to prevent medication from leaking around annular spacer 64, thereby bypassing passage 44. A needle mounting disk 70 is positioned immediately adjacent end 60 of end cap 56. Needle 28 is secured to and extends through needle mounting disk 70 with second end 32 of needle 28 extending through passage 62 in end 60 of end cap 56.

Figure 4:
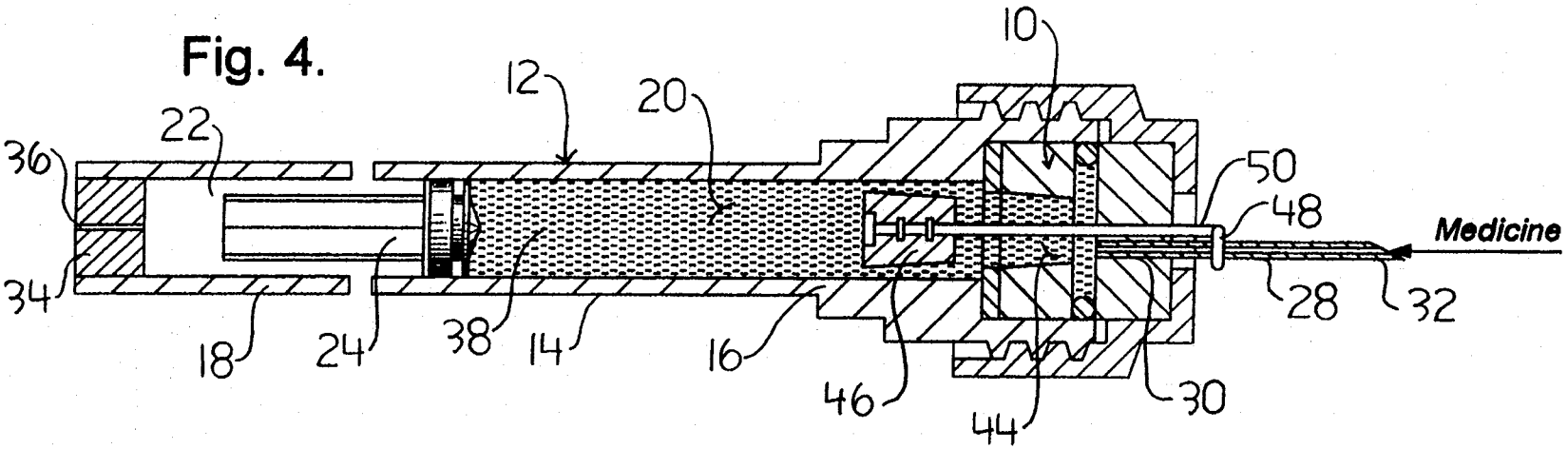
FIG. 4 is a detailed side elevation view in longitudinal section of the range animal injection apparatus as illustrated in FIG. 1 with the valve in an open position as the apparatus is loaded with a dose of medication.
Figure 5:
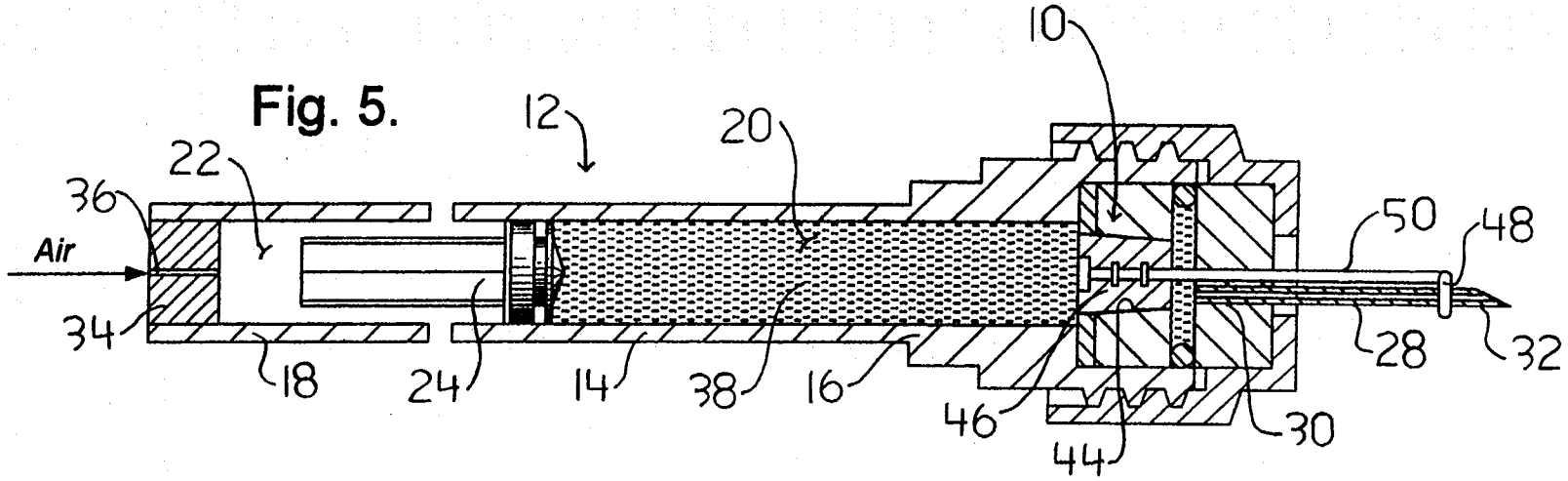
FIG. 5 is a detailed side elevation view in longitudinal section of the range animal injection apparatus as illustrated in FIG. 1 with the valve in an closed position while a pressure source upstream of the valve is pressurized.
Figure 6:
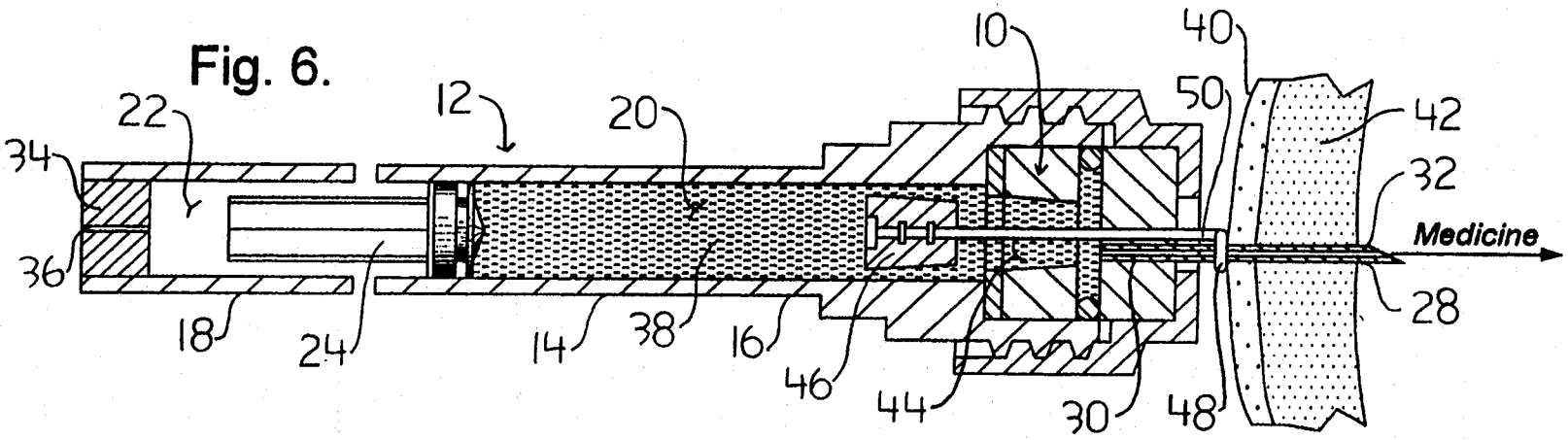
FIG. 6 is a detailed side elevation view in longitudinal section of the range animal injection apparatus as illustrated in FIG. 1 with the valve in an open position as medication is administered to an animal.
Figure 7:
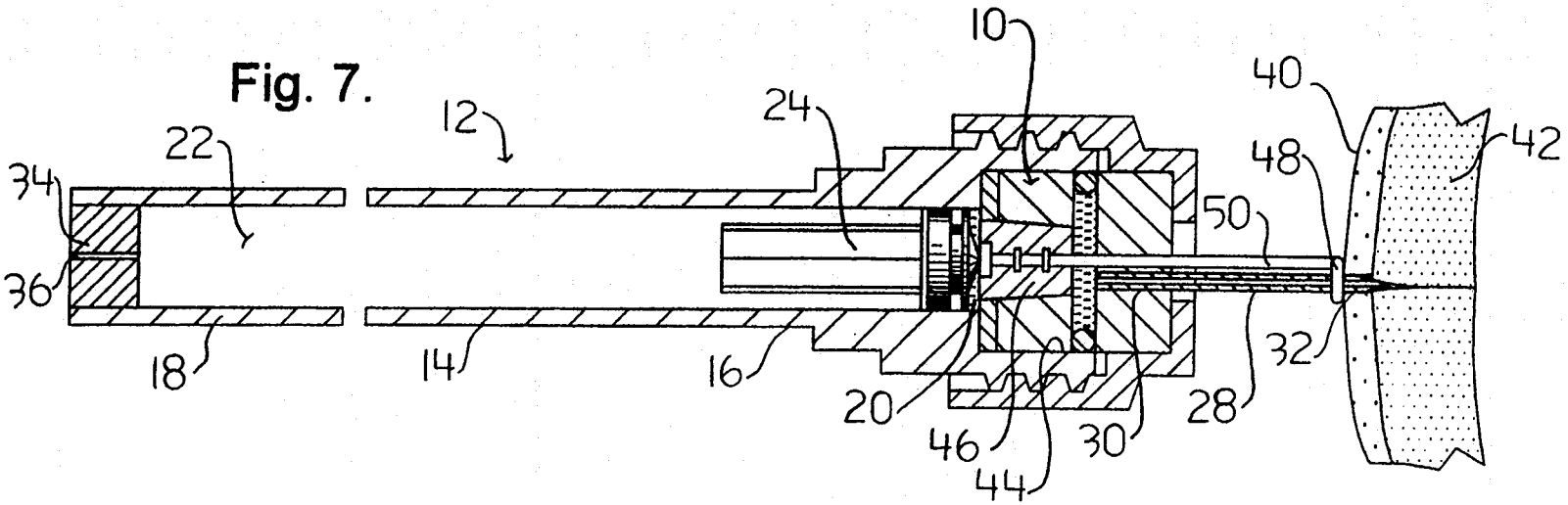
FIG. 7 is a detailed side elevation view in longitudinal section of the range animal injection apparatus as illustrated in FIG. 1 with the valve in closed position as the apparatus is ejected from the animal.

The use and operation of the retrieval system on arrow 12, including valve 10, will now be described with reference to FIGS. 1 through 7. Referring to FIG. 4, with the illustrated embodiment in order to put medication 38 into syringe compartment 20, valve 10 is placed into the open position by exerting a force upon contact member 48 until contact member 48 moves toward first end 30 of needle 28 thereby pushing valve member 46 out of passage 44. Medication 38 may then be inserted through needle 28 into syringe compartment 20. A force is then exerted upon contact member 48 until contact member 48 is positioned adjacent the second end 32 of needle 28, as illustrated in FIG. 5. This draws valve member 46 into passage 44, placing valve 10 into the closed position. A needle valve (not shown) may then be inserted into self sealing passage 36 of rubber plug 34. Using a bicycle pump air is then pumped through self sealing passage 36 to pressurize pressure compartment 22. Due to the presence of movable plunger 24 disposed between pressure compartment 22 and syringe compartment 20; the pressurization of pressure compartment 22 places medication 38 in syringe compartment 20 under equal pressure with pressure compartment 22. Referring to FIG. 6, when second end 32 of needle 28 enters hide 40 of animal 42, contact member 48 is pushed toward first end 30 of needle 28 by hide 40. Needle 28, as illustrated, is a needle best suited for intra-muscular injections. It will be appreciated that by modifying needle 28 subcutaneous injections can be achieved. Due to the presence of rigid coupling 50, as contact member 48 moves valve member 46 is moved until valve 10 is in the open position. Once valve 10 is in the open a differential in pressure is created as between syringe compartment 20 and pressure compartment 22. Pressure compartment 22 remains under pressure, whereas the pressure in syringe compartment 20 is released via needle 28. The greater air pressure within pressure compartment 22 causes plunger 24 to move shortening the length of syringe compartment 20 and urging liquid medication 38 in syringe compartment 20 passed open valve member 46 along passage 44 and through needle 28 until liquid medication 38 has vacated syringe compartment 20. Even after liquid medication 38 has completely vacated syringe compartment 20 a differential in pressure remains. Continued pressure from within pressure compartment 22 then urges valve member 46 back into passage 44 placing valve 10 back into the closed position, as illustrated in FIG. 7. Due to the presence of rigid coupling 50, the movement of valve member 46 serves to move contact member 48 toward second end 32 of needle 28 until contact member 48 pushes needle 28 out of hide 40 of animal 42.

It will be apparent to one skilled in the art that modifications may be made to the illustrated embodiment without departing from the spirit and scope of the invention as hereinafter defined in the claims. In particular, it will be apparent that the range animal injection apparatus can take other forms, such as a pole or a dart. It will also be apparent that the syringe can be external, and need not be positioned within hollow shaft 14.

The embodiments of the invention in which an exclusive property or privilege is claimed are defined as follows:

1. A retrieval system for a range animal injection apparatus having a syringe positioned along a shaft with a needle having a first end secured to the syringe and a second end projecting past a remote end of the shaft, a pressure source acting upon a plunger in the syringe to force liquid medication from the syringe through the needle upon the second end of the needle being inserted into a hide of an animal, the retrieval system comprising:

a valve positioned adjacent a first end of the needle, the valve including a passage and a pressure sensitive valve member movable axially in relation to the passage, between an open position in which the valve member is spaced from the passage thereby allowing the free flow of liquids from the syringe to the needle, and a closed position in which the valve member is lodged in the passage thereby precluding the flow of liquids from the syringe to the needle;

a contact member movably axially in relation to the needle between the first end and the second end;

a rigid coupling for coupling the movement of the contact member and the valve member, the valve being in a closed position when the contact member is positioned adjacent the second end of the needle, the valve being in an open position when the contact member is positioned adjacent the first end of the needle, such that when the second end of the needle enters a hide of an animal the contact member is pushed toward the first end of the needle by the hide of the animal forcing the valve into the open position while pressure from the pressure source urges liquid medication in the syringe passed the open valve member through the needle until the liquid medication has vacated the syringe, continued pressure from the pressure source then urging the valve member into the closed position, thereby moving the contact member toward the second end of the needle until the contact member pushes the needle out of the hide of the animal.

* * * * *